United States Patent [19]

Freeman et al.

[11] 4,259,858

[45] Apr. 7, 1981

[54] VACUUM-PNEUMATIC POWER TOOL

[76] Inventors: Richard B. Freeman, 1920 NW. 31st Ter., Gainesville, Fla. 32605; Alfred W. Schmidt, Box 787, Keystone Heights, Fla. 32656

[21] Appl. No.: 44,246

[22] Filed: May 31, 1979

[51] Int. Cl.[3] ..... B21J 15/34

[52] U.S. Cl. ..... 72/391; 72/453.17; 92/85 R; 92/111

[58] Field of Search ..... 72/391, 453.17; 92/85 R, 111, 130 R

[56] References Cited

U.S. PATENT DOCUMENTS

| | | | |
|---|---|---|---|
| 3,415,102 | 12/1968 | Elliott | 72/391 |
| 3,430,539 | 3/1969 | Freeman | 92/85 R |
| 3,457,763 | 7/1969 | Freeman | 72/391 |
| 3,523,441 | 8/1970 | Bell | 72/453.17 |
| 3,554,088 | 1/1971 | Bruyn | 92/111 |
| 3,630,067 | 12/1971 | Henshaw | 72/391 |
| 4,062,217 | 12/1977 | Ebbert | 72/391 |

*Primary Examiner*—Francis S. Husar
*Assistant Examiner*—Gene P. Crosby
*Attorney, Agent, or Firm*—Isler and Ornstein

[57] ABSTRACT

A power tool in the form of a fluid pressure cylinder utilizing multiple movable pistons coupled for contemporaneous pressure-responsive working movement, as well as for return to no-load position. Individual pressure buildup on each pressure chamber is controlled by pre-selected imput and exhaust orifice sizes for each chamber, which also permit better control of lubricant dispersal to the successively more remote chambers.

13 Claims, 6 Drawing Figures

VACUUM-PNEUMATIC POWER TOOL

BACKGROUND OF THE INVENTION

Fluid-powered tools, particularly pneumatic tools, are used in a great variety of work applications. This invention relates primarily to pneumatic power tools, particularly of the type used as a clinching tool or blind rivet tool, such as disclosed in prior U.S. Pat. Nos. 3,430,539 and 3,457,763.

One of the problems with tools of the type disclosed in these prior art patents is adequate dispersal and delivery of aspirated lubricant mist to those pressure chambers of the tool which are successively more remote from the valved entry port of the air supply for the tool. There is a tendency for the atomized lubricant mist to precipitate out of its air carrier as it enters the first or nearest pressure chambers of the tool, thus substantially depleting the carrier of adequate lubricant content for the remaining chambers. The tendency for precipitation can be lessened by increasing the cross-sectional area of the entry port, but this increased input volume of pressurized air increases the rate of pressure buildup in the chambers and adversely affects the operating characteristics of the pistons and increases the retractive impact of the tool when the load on it is suddenly relieved, as in blind riveting.

The reference prior art structures use a manifold air distribution structure of uniformly-sized passageways and orifices for delivery of pressurized air to the several chambers. This results in a substantially simultaneous pressure buildup in all of the chambers, rather than a controlled differential buildup in the successive chambers for improved operating characteristics, decreased withdrawal impact of the tool, and better speed control.

The prior art structures also utilize coil spring biasing elements for restoring the pistons of the tool to load-engaging position after the pneumatic operating pressure is shut off. The operating pressure therefore has to be great enough not only to do the required work of the tool, but also to energize the compression coil spring.

All of the above present problems to which the improvements of the present invention are directed.

SUMMARY OF THE INVENTION

It is an object of the invention to provide an improved form of air delivery and air exhaust system to the chambers of a multi-piston pneumatic work tool.

Another object of the invention is to provide a pneumatic tool with an improved lubricant delivery system.

A further object is to provide a pneumatic tool structure having improved speed control characteristics under load.

Still another object is to provide a pneumatic multi-piston work tool having greater ease of assembly and improved performance.

Other objects and advantages will become apparent during the course of the following description.

DESCRIPTION OF THE PREFERRED EMBODIMENTS

In the drawings, in which like reference numerals designate like parts throughout the same, FIG. 1 is a longitudinal sectional view of a pneumatic tool embodying the features of the invention.

Figure 1:
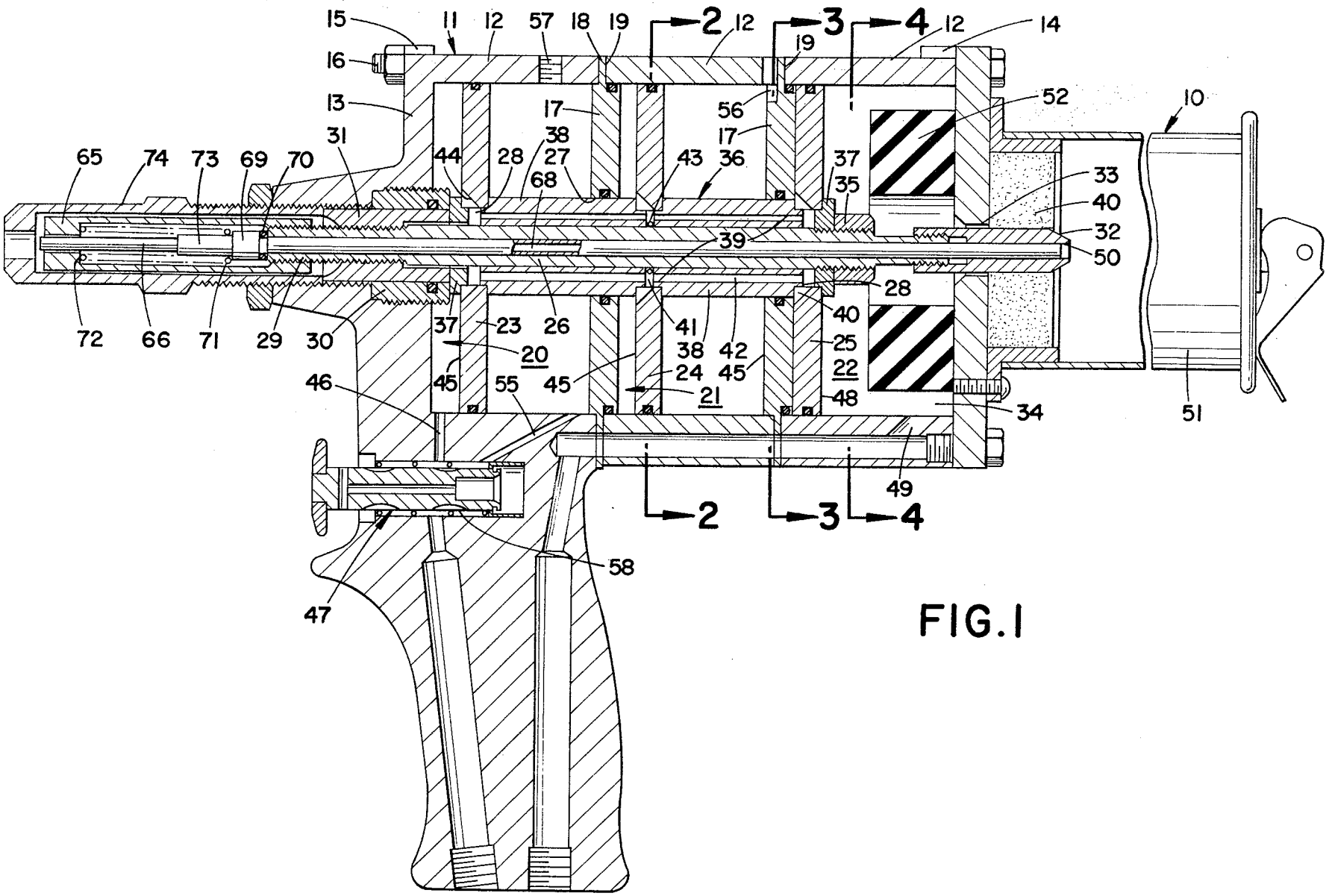
Figure 2:
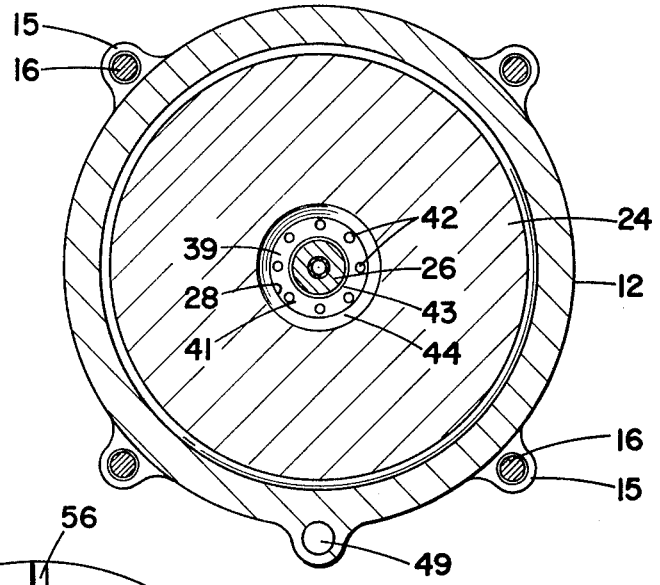
FIG. 2 is an enlarged transverse cross-sectional view taken as indicated on line 2—2 of FIG. 1.
Figure 3:
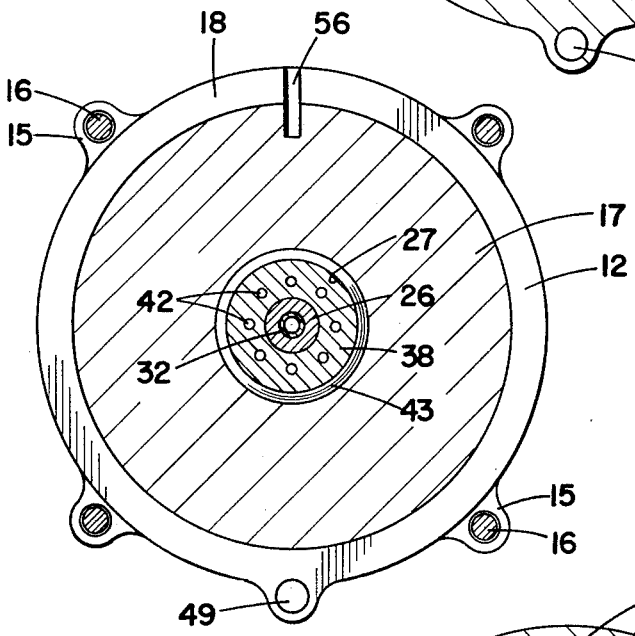
FIG. 3 is an enlarged transverse cross-sectional view taken on line 3—3 of FIG. 1.
Figure 4:
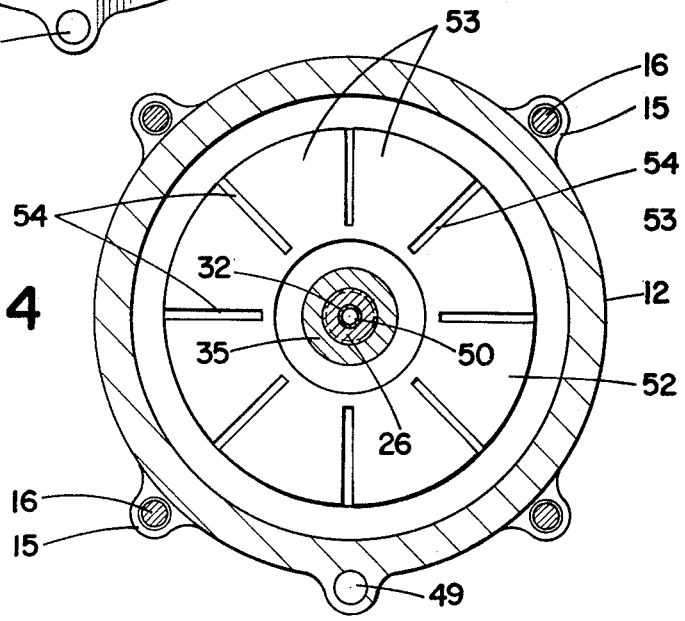
FIG. 4 is an enlarged transverse cross-sectional view taken on line 4—4 of FIG. 1.

Referring more particularly to the drawings, the pneumatic power tool 10 includes a cylindrical housing or body 11 which comprises a plurality of discrete segments 12 in coaxial alignment with each other and with a front end cap 13 and a rear end cap 14. The end caps have apertured ears 15 to accommodate stay-bolts 16, several of which are circumferentially spaced from each other about the body and serve to secure and clamp the parts 12, 13 and 14 into the desired assembled relationship to form the housing 11.

A disk-shaped baffle plate 17 having a peripheral, diametrically-extending flange portion 18 is disposed and clamped intermediate the adjacent ends 19 of each pair of cylindrical segments 12, so as to partition the interior of the housing 11 into a front chamber 20, a middle chamber 21 and a rear chamber 22. It will be understood that there may be more or less of such baffle plates forming more or less of such chambers, the illustrated embodiment being examplary only.

In each chamber is slidably mounted a disk-shaped plate or piston. The piston for the front chamber is designated 23; the middle chamber piston is 24; and the rear piston is designated 25. As will appear more fully hereinafter, the pistons 23–25 could be uniformly alike or may have dissimilarities from each other.

Extending longitudinally centrally of the body 11 is a tubular stem or tie rod 26 which traverses the central openings 27 and 28 provided in the baffles 17 and the pistons 23–25, respectively. The stem 26 has a work-engaging forward externally threaded end 29 which projects outwardly through the front cap 13 and which is operatively associated with a suitable nosepiece. The cap 13 has threadedly secured thereto a guide bearing 30 which slidably accommodates the longitudinal movement of a lock nut 31 which is secured to the threaded end 29 of the stem.

The opposite or rearward end 32 of the rod 26 projects through an opening or bore 33 in the rear end cap 14 and communicates with a low pressure or vacuum space 34 for a purpose to be described. Adjacent this rearward end, a lock nut 35 is threadedly secured to the rod and coacts with the other lock nut 31 to clamp the pistons and associated parts into an assembly 36 fixed to and movable with the rod 26. A recessed or flanged collar 37 is carried on the stem 26 and interposed between each of the lock nuts and their contiguous pistons 23 or 25.

A tubular piston spacer element 38 having end portions 39 of reduced diameter extends between each pair of pistons, with the portions 39 received in the central opening or bore 28 of the piston and spaced from each other and from the collars 37 to provide a circumferentially-extending fluid passageway 41 within the bore 28. Each passageway 41 has separate communication with an annular passageway or passageways 42 extending longitudinally of each spacer 38. An O-ring 43 between adjacent ends of the spacers 38 serves to seal these ends and make the passageway 42 continuous and air-tight.

Each piston is provided with an angularly directed notch or channel 44 on pressure face 45 extending into communication with the passageway 41. The notch 44 on any one of the pistons can be of a different size or cross-sectional area than the notch on any other, so as to act as an entry orifice control for metering the volume flow into each chamber independently of the others. Thereby, for example, the sized notches may be arranged to permit rapid pressure and force buildup on pistons 23 and 24 and a lagging force buildup on piston 25 to achieve desired speed control of the work operation while at the same time establishing a greater uniformity and sensitivity in the control of the operating force required for the work.

Furthermore, each of the separate spacer elements may also be sized to have a metering function for fluid flow control, thus increasing the versatility of the tool.

By utilizing individual imput and exhaust metering orifices for each chamber, there is no longer need to rely solely upon the size of the valve entry port or orifice 46 for speed and volume control. The port 46 can be relatively oversize, thereby reducing the initial precipitation of the aspirated lubricant mist which is induced by a sudden severe restriction in the size of the valve port. The larger permissible valve port allows the air to carry lubricant mist in adequate amounts to the more remote chambers 21 and 22 without the lubricant depletion resulting from premature and excessive lubricant precipitation which would otherwise occur in the front chamber 20.

Any suitable valving arrangement 47, schematically illustrated, can be used, using conventional forms of button or trigger actuation or the like. When the valve 47 is actuated to an operating mode, compressed air is directed through the entry port 46 into the front chamber 20 to exert force on the pressure face 45 of piston 23. The air enters the passageway 42 through the notch 44 of piston 23 and its associated passage 41; it enters chamber 21 through passage 41 and notch 44 of piston 24; and enters chamber 22 through the like passageways of piston 25. As previously indicated, the orifices leading to each of the chambers may vary in size so that, for example, the pressure buildup in chambers 20 and 21 may approach maximum well before chamber 22. The pressure buildup in chamber 22 will then occur more slowly and, as soon as the total pressure force on the three pistons is sufficient to overcome the load, as in a blind riveting operation, fracture will occur to relieve the load and the rod 26 will retract. It will be understood that suitable gripping means, collets or other devices will be attached to the forward end 29 of the rod for proper engagement with the load, as known to those skilled in the art.

At the same time that the compressed air is being directed into the chambers, the rear face 48 of piston 25 is exposed to sub-atmospheric or low pressure from a source of vacuum (not shown) which is ported into this portion 34 of the chamber 22 rearwardly of the piston 25 through passageway 49. Thereby, the pressure differential on piston 25 which is created by the compressed air, is supplemented and augmented by the additional differential provided by the vacuum. Thus, not only can the magnitude of force of the tool and the rate of pressure buildup be controlled through the selective sizing of the compressed air orifices, but an additional factor of control is provided by the degree of vacuum to which piston 25 is exposed.

A further measure of control of the tool is provided by the rate of venting or exhaust permitted by the exhaust orifices which can be sized during manufacture to achieve predetermined operating performance. The front chamber 20 contains entrapped air between the piston 23 and its baffle plate 17. As the piston 23 is urged rearwardly or to the right (as viewed in FIG. 1) by the entry of the compressed air through port 46, the entrapped air behind the piston is forced out and exhausts through passageway 55 into the restricted exhaust passageway or orifice 58 provided in the valve 47.The size of this exhaust orifice 58 establishes the rate of discharge or venting of the entrapped air from chamber 20 and thereby controls the rate of piston displacement.

Similarly, the entrapped air in the middle chamber 21, is vented at a controlled rate through sized exhaust orifice 56 which is provided n the periphery of the contiguous baffle plate 17.

Due to the vacuum imposed on the portion 34 of the rear chamber 22, there is less entrapped air in this chamber than in the others, but exhaust control can still be exercised by proper sizing of the passageway 49 which serves as the exhaust orifice for this chamber.

Thus, when the application of the tool requires an extremely rapid buildup of force on the piston and a slow rate of displacement, the exhaust orifices are sized to vent slowly and resist piston displacement. If a slow buildup of force and rapid displacement is desired, the exhaust orifices are sized for rapid venting. However, some intermediate degree of performance between these operational extremes is more usually desired and can be accomplished with a high degree of precision by predetermined sizing of all or some of the exhaust orifices.

The vacuum in the portion 34 of chamber 22 also serves a second purpose. The bore 50 of the hollow rod 26 is exposed to the vacuum at its end 32 and will draw or suck the fractured rivet shanks or the like from the forward end of the rod toward the rear of the tool for ejection. Preferably, an air-tight container or boot 51 can be provided on the end cap 14 to retain the ejected scrap. Any suitable form of filter 40 is interposed between tool chamber 34 and the boot 51 to prevent the scrap or dirt from entering the vacuum passageways. The close proximity of the scrap reservoir or boot 51 to the nosepiece of the tool increases suction efficiency and eliminates long vacuum lines.

Figure 5:
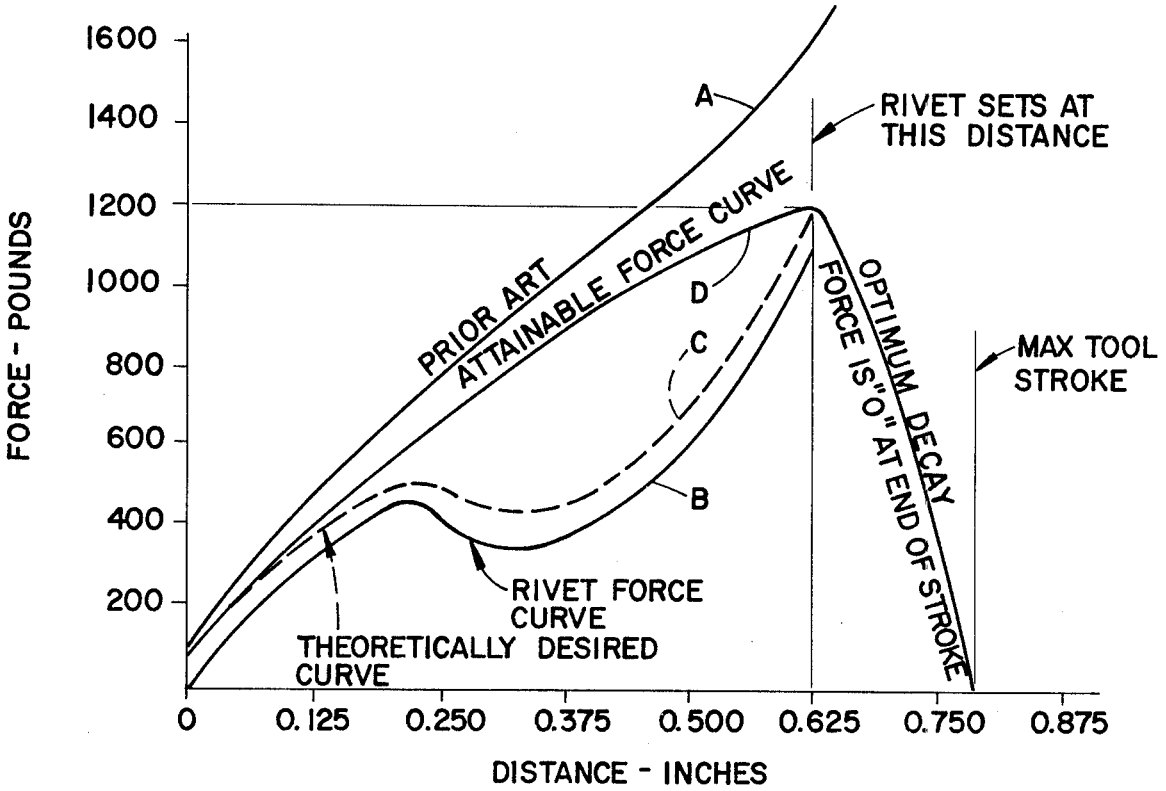
FIG. 5 is a representative graph indicating the characteristics of the tool operating forces.

Blind rivet setting forces are a function of mandrel size and physical characteristics of the rivet material. As indicated in the graph of FIG. 5, which plots pounds of force achieved by a pneumatic tool against displacement of the workpiece, most tool have a gradual force buildup, as shown in curve A, which causes displacement until rivet setting and mandrel fracture occurs; but the force of the tool still continues to increase beyond this point, without any useful purpose or accomplishment. In fact this continued application of force not only consumes energy unnecessarily, but results in undesirable impact and shock on the elements of the tool as it reaches the end of its stroke, after sudden release of work load.

Curve B represents the necessary force values required to be imposed on the rivet to achieve setting of the rivet. It will be noted that the initial tensile forces peak with relatively little displacement. The force requirement then diminishes and then again increases as the elastic limit of the rivet is approached.

Theoretically, as shown in curve C, if the tool and the forces it generates could follow curve B with just a slight excess in force values, optimum operating characteristics of a tool would be achieved. From a practical standpoint, optimum results are approached when the force available at the tool jaws is slightly greater than the force required to set the rivet, and this force is substantially dissipated thereafter in the remaining length of stroke. The present invention more closely approaches this optimum, as indicated in its operating characteristics, plotted in curve D.

By utilizing orificing control, as described, and restricting output orificing, a higher pressure level and force value can be attained in a shorter period of time. With judicious sizing of the various orifices, optimum pressure-displacement characteristics can be achieved and over-shooting of the threshold of required setting force is minimized.

When the operating forces of the tool are relatively low or when the nature of the work to be performed does not result in a sudden release of load on the tool, the orificing control will suffice to prevent excessive withdrawal or retraction impact of the piston assembly. No auxiliary shock absorber for retraction impact will be required. However, if these moderate operating conditions do not exist, it is preferable that a suitable shock absorbing device be used. Although springs or rubber bumpers have been utilized for such purpose, I have found that these conventional forms of shock absorbers buildup reactive forces too rapidly for optimum results and do not effectively dampen impact to the extent desired.

An improved unitary shock absorber 52 is provided, made of rubber or other elastomeric material, and consisting of circumferentially spaced lobes 53 created by slotting as at 54. At the initial instant of impact of piston 25 on the shock absorber, its reaction force is substantially zero. As the lobes 53 are displaced by the pistn face 48, the lobes are deformed and caused to bulge into contact with each other producing a gradually increasing reactive force in response to increased deformation and displacement until the withdrawal movement of the pistonassembly is arrested, and then partially reversed when the air pressure is relieved. As illustrated, the shock absorber is suitably secured to the interior face of the end cap 14.

When the retraction stroke is completed, the flow of compressed air through valve port 46 is shut off and the compressed air is directed through passageway 55 into chamber 20 rearwardly of the piston 23 to cause advance and return of the piston assembly 36 to loading position. This arrangement eliminates the need for a separate return spring and reduces the cost and number of parts required for the tool. More importantly, the elimination of a return spring means that the retraction force applied to the piston assembly need be of a magnitude sufficient only to perform the work loads and need not be increased to overcome the additional load which would be impressed on the piston assembly by energization of a return spring. The channel 55 may also serve, if desired, as a relief vent to atmosphere through valve 47 for chamber 20 during retraction of piston 23.

The use of the flanged baffle plates 17 also reduce the cost of the tool and enhances its utility. The cost of a unitary cylinder body is eliminated, as well as the cost of internal machining for baffle retaining rings and the rings themselves, as required in U.S. Pat. No. 3,430,539. The increased clamping area provided by the baffles 17 interposed between cylinder body segments 12, result in greater rigidity of baffle plate structure and more precise positioning.

One or more of the baffles 17 can be slotted, as at 56, to provide a relief vent to atmosphere for its associated chamber, rearwardly of the piston. One or more of the baffles may also be utilized for example as at opening 57, for the connection of probes, sensors or recording instruments for monitoring pressure or vacuum, if desired. Any such modifications of the baffle plates are readily and economically accomplished by machining operations on the baffle 17 prior to assembly. By utilizing modules of segments 12 and baffle elements 17, the tool can be customized to include desired features and a greater or lesser number of chambers and pistons to meet particular job requirements.

Figure 6:
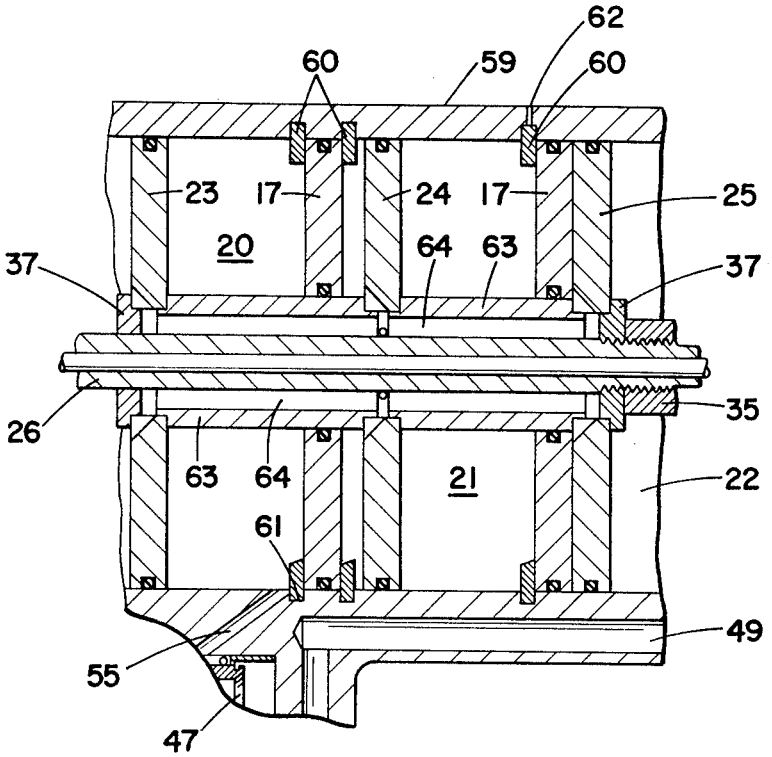
FIG. 6 is a fragmentary cross-sectional view similar to FIG. 1, but showing a modified form of tool structure.

In FIG. 6 there is shown a modified form of the invention which utilizes a continuous cylindrical body 59 in lieu of the segmented body structure 11 previously described. In this form, split locking rings 60 are mounted in machined recesses 61 interiorly of the body and closely adjacent the baffles 17 to retain them against displacement in at least one direction. The body can be apertured, as at 62, to vent chambers, such as 21, during operation of the tool.

In FIG. 6 there is also shown a modified form of spacer element 63 whose bore is milled or broached to provide one or more longitudinally-extending recesses 64 which serve as air channels or manifolds in the same manner as the previously described drilled openings 42 of spacers 38. It will be understood that other forms of passageway configurations can be provided by suitable milling, broaching, threading or drilling of the spacer elements. The recesses 64 of one spacer element 63 may be of different cross-sectional area than the recesses 64 of another spacer 63 to achieve predetermined orifice control of air input to the separate chambers of the multi-piston cylinder, just as the previously described passageways 42 may be uniform or of different size in different spacers 38.

One of the recurrent problems encountered in powered blind rivet tools is jamming of the scrap mandrels in the bore 50 of the tubular rod 26. This jamming occurs when the mandrel of the blind rivet is bent, either in the riveting procedure or in the manufactured rivet. Such a bent mandrel has a tendency to hang up in the bore 50 or because it doesn't have a straight longitudinal axis, it may overlap and wedge into a preceding or succeeding scrap mandrel and block normal discharge of the scrap through the bore.

When such scrap blockage occurs, it has been necessary to disassemble the tool to remove the stem 26 and then attempt to knock out or drive out the jammed scrap from the bore. This is not only time-consuming, but can also cause damage to the stem 26.

As best shown in FIG. 1, we have provided an improved stem structure which, although it does not eliminate jamming, makes it much easier and less time-consuming to correct the problem when it occurs. The forward threaded end 29 of the stem 26 has secured thereto a conventional collet assembly 65 which serves to grip the mandrel of the rivet in the operation of tool, in a manner known to the art. A liner sleeve or tube 66 has its forward end 67 projecting into the collet to receive the end of the mandrel of the rivet. The tube 66 fits slidably into the bore 50 of the stem 26 and extends therethrough toward the rearward end 32 of the stem to provide a passageway 68 for the scrap.

A stop collar 69 is fixed to the exterior of sleeve 66 so as to abut the forward end 29 of the stem 26 and limit rearward movement of the sleeve relatively to the stem. A resilient ring or gasket 70 is mounted on the sleeve 66 between the collar 69 and end 29 of the stem to serve a dual function. The ring 70 serves as a shock absorber to relieve the impact force between collar 69 and stem 26 which occurs when the rivet mandrel is fractured. Secondly, the ring 70 serves as a seal to contain the low pressure or vacuum to which the passageway 68 and bore 50 is exposed, as previously described.

A compression coil spring 71 has one end thereof seated on the stop collar 69 and its other end seated on a collet shoulder portion 72 so as to yieldably retain the collar in abutment with the ring 70 and compress it against the end 29 of the stem. Preferably, the collar 69 is provided with a forward extension 73 of reduced diameter to act as a guide for the spring 71.

In the event jamming of the scrap occurs, it is only necessary to remove the nosebarrel 74 and collet assembly 65 to permit the slidable removal of the sleeve 66 from the stem 26, without the need for disassembly of the stem. A replacement sleeve 66 is slidably inserted and the tool is quickly reassembled for continued operation. As the sleeve is a low-cost, expendable item, its replacement is far less costly than the time and effort which would be required to disassemble the stem 26, attempt to drive out the scrap blockage, and reassemble the stem in the tool. Furthermore, the likelihood of damage to the stem is eliminated. If the jamming has not been too severe, it may even be possible to re-use the sleeve 66, if desired, although such re-use would seldom be warranted.

It is to be understood that the forms of our invention herewith shown and described, are to be taken as preferred examples of the same and that various changes in the shape, size and arrangement of parts may be resorted to, without departing from the spirit of our invention, or the scope of the subjoined claims.

Having thus described our invention, we claim:

1. In a multi-piston pneumatic power tool for blind riveting and the like, the combination of a cylinder body, a plurality of baffle elements mounted in said body in axially-spaced relationship to partition said cylinder into a plurality of separate chambers, a piston slidably mounted in each chamber for pressure-responsive movement in said cylinder, spacer elements engaging said pistons to maintain them in axially-spaced relationship to each other, a tubular longitudinally-extending stem traversing said pistons for presenting a work-engaging member at the forward end thereof, means for securing said stem for contemporaneous axial movement with said pistons, said spacer elements providing a manifold fluid passageway for said chambers, a second fluid passageway provided by each piston between said manifold passageway and one of said chambers, selective valve means for supplying compressed air to said manifold passageway and said chambers to one side of said pistons to displace said pistons to retract said stem, piston-advancing means for restoring said stem to its initial position after retraction thereof, and means for supplying air suction to the opposite side of the piston in a portion of at least one of said chambers during pressure-induced retraction of said stem to increase the pressure differential on the piston.

2. A combination as defined in claim 1, wherein said piston-advancing means includes a flow channel associated with said valve means for directing said compressed air to the opposite side of at least one of the pistons to advance said stem in response to the closing of the air supply to said manifold passageway.

3. A combination as defined in claim 1, wherein said air suction is supplied to the rearward-most chamber, a scrap reservoir is mounted on said tool in communication with the low-pressure portion of said rearward-most chamber, and the rearward end of said tubular stem projects into said reservoir, whereby the scrap formed at the forward end of said stem is drawn axially through said stem into said reservoir by said air suction.

4. A combination as defined in claim 3, including a tubular sleeve slidably mounted coaxially in said stem and providing a passageway for said scrap, and means for retaining said sleeve against displacement relatively to said stem.

5. A combination as defined in claim 4, wherein said retaining means is yieldable.

6. A combination as defined in claim 1, wherein at least portions of each of said spacer elements circumferentially engage said stem in substantially fluid-sealing relationship therebetween, and each of said spacer elements is provided with circumferentially-spaced longitudinally-extending channels therein for establishing said manifold fluid passageway.

7. A combination as defined in claim 6, wherein said longitudinally-extending channels are disposed wholly within said spacer elements to isolate said manifold passageway from said stem.

8. A combination as defined in claim 6, wherein said longitudinally-extending channels are disposed on the inner periphery of said spacer elements in circumferentially-interrupted communication with said stem.

9. In a power tool for blind riveting and the like having a movable tubular tie rod extending substantially centrally thereof and providing a passageway for the discharge of scrap from the forward end of the tool to the rearward end thereof, the combination of a tubular sleeve slidably mounted coaxially in said passageway and substantially coextensive therewith, an abutment provided on said sleeve to limit movement of said sleeve relatively to said tie rod in one longitudinal direction, spring means engaging said sleeve to yieldably limit movement of said sleeve relatively to said tie rod in the opposite longitudinal direction, and means for directing scrap through said sleeve for discharge from the rearward end thereof, said means comprising a vacuum reservoir communicating with the discharge end of said sleeve, and including a ring seal on said sleeve at the forward end of said tie rod for retaining said vacuum in said sleeve and tie rod assembly.

10. A combination as defined in claim 9, wherein said ring seal is resilient and is interposed in shock-absorbing relationship between said sleeve and said tie rod to absorb impact forces therebetween.

11. In a power tool for blind riveting and the like having a movable tubular tie rod extending substantially centrally thereof and providing a passageway for the discharge of scrap from the forward end of the tool to the rearward end thereof, a closed scrap reservoir carried by said tool on the rearward end thereof in communication with said scrap-discharge passageway, means for imposing air suction on the interior of said tool, a flow passage communicating said suction directly from said tool to the forward end of said reservoir to draw air from said reservoir to said tool in a direction opposite to the flow of air from said scrap-discharge passageway to said reservoir, whereby scrap is drawn by said air suction through said passageway and discharged into said reservoir in a direction opposite to the direction of discharge of air from said reservoir.

12. A combination as defined in claim 11, including an air filter disposed between said reservoir and said tool in the path of air flow therebetween, said filter being disposed out of the path of the scrap discharge from said rod.

13. In a multi-piston pneumatic power tool for blind riveting and the like, the combination of a cylinder body, a plurality of baffle elements mounted in said body in axially-spaced relationship to partition said cylinder into a plurality of separate chambers, a piston slidably mounted in each chamber for pressure-responsive movement in said cylinder, spacer elements engaging said pistons to maintain them in axially-spaced relationship to each other, a tubular longitudinally-extending stem traversing said pistons for presenting a work-engaging member at the forward end thereof, means for securing said stem for contemporaneous axial movement with said pistons, said spaced elements providing a manifold fluid passageway for said chambers, a second fluid passageway provided by each piston between said manifold passageway and one of said chambers, selective valve means for supplying compressed air to said manifold passageway and said chambers to one side of said pistons to displace said pistons to retract said stem, shock absorber means mounted in the path of retractive movement of at least one of said pistons, said shock absorber means presenting a plurality of discrete resilient lobes spaced from each other and deformable into increasingly compressive abutment with each other in response to retraction impact thereon for progressively increasing resistance to deformation displacement by piston impact, and means for restoring said stem to its initial position after retraction thereof.

* * * * *